US008056831B2

(12) United States Patent
Crampton

(10) Patent No.: US 8,056,831 B2
(45) Date of Patent: Nov. 15, 2011

(54) ROTARY FOAM DISTRIBUTOR

(75) Inventor: George Patrick Crampton, Carp (CA)

(73) Assignee: National Research Council of Canada, Ottawa, ON ( * ) Notice: Subject to any disclaimer, the term of this patent is extended or adjusted under 35 U.S.C. 154(b) by 138 days.

(21) Appl. No.: 11/106,503

(22) Filed: Apr. 15, 2005

(65) Prior Publication Data

US 2006/0237198 A1 Oct. 26, 2006

(51) Int. Cl.
*B05B 3/04* (2006.01)

(52) U.S. Cl. ..... 239/237; 239/222; 239/240; 239/263; 239/381; 239/383

(58) Field of Classification Search ..... 239/222–223, 239/227, 233, 237, 399, 214.13, 214.15, 239/214.21, 217, 222.11, 222.17, 240, 380–389, 239/462, 499, 518, 520, 521, 590, 590.3, 239/263; 169/78, 73

See application file for complete search history.

(56) References Cited

U.S. PATENT DOCUMENTS

| | | | | |
|---|---|---|---|---|
| 1,523,609 | A | 1/1925 | Roach | |
| 2,535,469 | A * | 12/1950 | Wanke | 239/222.15 |
| 3,091,399 | A * | 5/1963 | Kennedy | 239/222.13 |
| 3,526,363 | A * | 9/1970 | Hauser | 239/206 |
| 3,645,451 | A * | 2/1972 | Hauser | 239/206 |
| 4,501,391 | A | 2/1985 | Hunter | |
| 4,613,077 | A * | 9/1986 | Aronson | 239/97 |
| 4,708,290 | A * | 11/1987 | Osmond | 239/227 |
| 4,923,013 | A | 5/1990 | De Gennaro | |
| 4,944,457 | A | 7/1990 | Brewer | |
| 5,772,117 | A * | 6/1998 | Su | 239/240 |
| 6,328,225 | B1 | 12/2001 | Crampton | 239/246 |
| 6,732,958 | B2 | 5/2004 | Norville et al. | 239/582.1 |
| 6,764,024 | B2 | 7/2004 | Crampton | 239/246 |
| 7,066,404 | B1 * | 6/2006 | Kollar | 239/288 |

FOREIGN PATENT DOCUMENTS

| | | | |
|---|---|---|---|
| CA | 2131109 | 11/2002 | 31/12 |
| GB | 2046129 | 11/1980 | |
| JP | 10057517 | 3/1998 | |
| JP | 11070184 | 3/1999 | |
| SE | 437937 | 3/1985 | |
| WO | WO 88/07849 | 10/1988 | |
| WO | WO 00/12177 | 3/2000 | |
| WO | WO 03/041805 | 5/2003 | |

* cited by examiner

*Primary Examiner* — Jason Boeckmann
(74) *Attorney, Agent, or Firm* — Jason E. J. Davis

(57) ABSTRACT

A self-powered foam (e.g. compressed-air foam (CAF)) distributor has a rotor mechanism with impingement surfaces against which foam impinges to rotate the rotor. The rotor is mounted on an inlet shaft geared to an output shaft. A rotary outlet is mounted to the output shaft so that foam entering the distributor rotates the rotary outlet, which in turn projects foam around in a circular sweep. The rotary outlet can rotate over a full 360 degrees, providing superior coverage for a large floor space, such as in hangars or warehouses, with less water and concentrate than in unfoamed conventional systems. Having a compact vertical profile this versatile distributor can be installed in a floor trench of a hangar or on a wall or ceiling. Since all rotational energy is harnessed from the pressure of the foam itself, no external energy source is required to power the distributor.

20 Claims, 3 Drawing Sheets

ROTARY FOAM DISTRIBUTOR

CROSS-REFERENCE TO RELATED APPLICATIONS

This is the first application filed for the present invention.

FIELD OF THE INVENTION

The present invention relates generally to fixed piping fire suppression systems and, more particularly, to a rotary-type foam distributor.

BACKGROUND OF THE INVENTION

A foam distributor is part of a fixed piping fire suppression system capable of projecting a stream of fire-extinguishing compressed-air foam or other compressed-gas foam. In the art of firefighting, it is known to use foam produced from a solution of a foam concentrate in water. The volume of the solution is expanded by the addition of air and mechanical energy to form a bubble structure resembling shaving cream. The bubble suffocates and cools the fire and protects adjacent structures from exposure to radiant heat. Foam is known to be very effective on liquid fires, e.g. fuel, oil or other flammable chemicals.

One current approach to covering large floor areas is to use an oscillating nozzle to deliver the unfoamed solution. As the solution is substantially unfoamed when delivered, a more expensive agent is required and a higher concentration of the agent (e.g. in the neighbourhood of 3 percent) is required. A greater volume of the solvent and water are required to effectively cover the same area, in comparison with systems that agitate the solution to produce a thicker foam. This greater volume increases a cost per use, requires a greater supply of water and solvent (which can constitute considerable infrastructure and costs), and greatly increases the cost of disposing of the waste after a fire. Given that the delivery is across a semicircular arc, and that an array of these oscillating nozzles are required to cover the large surface area, the oscillating nozzle must be positioned only on the sides of the building. Moreover, these devices typically require a separate flow to provide the mechanical power to run the device. These oscillating devices are therefore inconveniently large, use 4-10 times more solution per unit coverage area, cannot cover 360 degrees and are unsuitable for other mounting configurations.

Foam can be generated using an air-aspirating nozzle, which entrains air into the solution and agitates the mixture producing bubbles of non-uniform size. With an aspirating system, the foam is formed at the nozzle using the energy of the solution stream. Unfortunately this foaming typically removes substantially all of the mechanical energy of the solution stream and consequently a second flow is typically required to supply mechanical energy needed to distribute the foam. The duplication of supply, and the coordination of the two systems increases an expense of the system and makes the system inherently less reliable.

Foam can also be generated by injecting air under pressure into the solution stream. The solution and air mixture are scrubbed by the hose (or pipe) to form a foam of uniform bubble size. The energy used in this system comes from the solution stream and the air injection system. This system produces a "compressed-air foam" (CAF) which is capable of delivering the foam with a greater force than a comparable aspirated system described above.

As is known in the art, compressed-air foam distributors are installed on ceilings and walls for fire-protection in a variety of applications, such as in warehouses and aircraft hangars. For example, in aircraft hangars, ceiling-mounted or wall-mounted foam distributors are poised to extinguish fires that might erupt if highly flammable jet fuel is accidentally ignited. The effectiveness of a distributor or a group of distributors to fight a fire depends on a number of factors, such as range or "reach", i.e. the distributor's ability to project the foam an adequate distance, area coverage, i.e. the floor space it can cover, reliability, compactness, power efficiency, etc. Improving the effectiveness of a distributor provides superior fire-suppression, thus requiring fewer distributors to cover a given facility, which accordingly reduces building costs and saves space.

As is known in the art, coverage can be improved by rotating the nozzle of the distributor. A rotating nozzle is described by Applicant in Canadian Patent 2,131,109 (Crampton) entitled "Foam Nozzle". This patent describes a foam nozzle having a stationary barrel and a rotary distributor with three tubular angled outlets. Other rotating nozzles are described in Applicant's U.S. Pat. Nos. 6,328,225 and 6,764,024 (Crampton) both of which are entitled "Rotary Foam Nozzle". These patents describe an inverted-T-shaped rotary nozzle having a pair of differently sized orifices in the rotating barrel for distributing CAF in a circular pattern. Although these distributors provide good fire-suppression coverage, it would still be desirable to improve the effectiveness of the rotary foam distributor to further improve its ability to rapid suppress and control fires.

Furthermore, the distribution of compressed-air foam from small (prior-art) rotary nozzles cannot be practically scaled up in size to cover large areas, as scaling up in flow and size causes the rotational speed to increase to unacceptable levels and does not significantly increase the size of the coverage area. These prior-art nozzles are thus restricted to applications that do not require large areas of coverage. As is known by those of ordinary skill in the art, the problem in extinguishing flammable liquid pool fires in crowded aircraft hangars is delivering the CAF to the floor, past obstructions such as the wings or other vehicle bodies. Therefore, what is needed to cover large floor areas with CAF is a distributor that can deliver CAF to great radial distances with close to flat horizontal projection. It is further desirable to provide a distributor that has a low profile that permits installation in recessed horizontal settings, such as in a protected trough in a floor of the hangar.

Applicant's U.S. Pat. No. 6,764,024 discloses an impeller-driven delivery system that uses pressure of a CAF flow to drive an impeller, which is coupled by an internally mounted gear box reducer within a closed housing to revolve an output shaft that, in turn, drives a diffuser. The diffuser is made to revolve to distribute the CAF in a radial pattern.

Applicant has found that greatly improved transfer of energy to a rotor, and a significantly more compact assembly, can be achieved with a different configuration. This configuration further provides a more robust, simpler, impeller and transmission system that is better suited to surviving extreme thermal and shock testing required of such devices.

Therefore, it would also be highly desirable to provide a rotary foam nozzle that is compact, capable of covering a full 360 degrees, supplies CAF that does not require large water flow rates, does not require a secondary power supply, can be mounted in multiple configurations, and is robust.

SUMMARY OF THE INVENTION

It is therefore an object of the present invention to provide a foam distributor that overcomes at least one of the deficiencies associated with the prior art as described above. The foam distributor in accordance with the present invention has an inlet for receiving foam from a supply of compressed foam, such as compressed-air foam or other types of fire-retardant foams. For example, compressed gas foams can be made of concentrates and water mixed with inert gasses, other than air. Upon entering the distributor, the foam impinges on one or more vanes (or other impingement surfaces) of an offset radial impeller, wheel or rotor mechanism mounted on an input shaft, thereby causing the radial impeller, wheel or rotor mechanism and the input shaft to rotate. An offset radial impeller, as used herein, denotes an impeller that revolves along an axis that is transverse to the direction of flow, and so is moved by the flow itself, and transverse movement of the flow as it deflects radially away from a centre of rotation of the impeller, which center of rotation being offset from the direction of flow so that significantly less pressure is applied to the impellers when not positioned within the flow. The input shaft is geared to an output shaft upon which is mounted a rotary outlet, which can be a diffuser or a rotating vent of constant cross-sectional area. The rotary outlet is thus rotated by the foam impinging on the vanes of the radial impeller, wheel or rotor mechanism. In operation, foam is projected in a circular sweeping pattern as the rotary outlet rotates relative to the distributor body.

The distributor can be configured with a 90-degree elbow or bend that diverts foam exiting a top surface of the distributor body. The foam is diverted 90 degrees so that foam is projected by the rotary outlet in a direction of a horizontal plane that is parallel to the inlet. The rotary outlet can rotate over a full 360 degrees, providing superior coverage for a large floor space, such as in hangars or warehouses, using a quarter to a tenth of the solution volume of conventional systems that do not foam the solution. Being compact, and having a particularly low vertical profile, this versatile distributor can be installed in a floor trench of a hangar or on a wall or ceiling. Since all rotational energy is harnessed from the pressure of the foam itself, no external energy source is required to power the distributor.

The rotary outlet can also be made to oscillate rotationally over a limited arc by virtue of a reciprocating mechanism in the gear train which constrains the motion of the output shaft relative to the distributor body. The angular velocity of the rotary outlet whether freely rotating or oscillating may preferably be between 60 and 180 RPM. It has been found that slower angular velocities, while providing for a longer reach of the foam or delivering a greater volume of foam per unit area in each pass, provides too much time between passes to optimally extinguish some fires, and conversely faster angular velocities tend to reduce the reach of the foam and to cause discontinuities within the foam (depending on foam characteristics). To achieve this angular velocity, the gear train may have a reduction ratio of between 6:1 and 30:1, which may best be produced with or without the intermediary idler gear. It will be appreciated that these figures may vary with flow properties of the foam, properties of the impeller, and properties of the rotary outlet, etc.

In accordance with an aspect of the present invention, a distributor for distributing foam for extinguishing a fire includes a distributor body having an inlet for receiving foam from a compressed foam supply; a rotor mechanism mounted for rotation within the body and offset from the inlet, the rotor mechanism having impingement surfaces against which foam impinges to cause the rotor mechanism to rotate; and a rotary outlet connected to the rotor mechanism for rotation of the outlet relative to the body when foam impinges on the impingement surfaces of the rotor mechanism.

In one embodiment, the rotary outlet is rotationally connected to the rotor mechanism for unconstrained 360-degree rotation of the outlet relative to the body when foam impinges on the impingement surfaces of the rotor mechanism.

In another embodiment, the rotary outlet is an oscillating rotary outlet connected to the rotor mechanism for oscillation of the rotary outlet relative to the body through a limited arc when foam impinges on the impingement surfaces of the rotor mechanism.

In yet another embodiment, the rotor mechanism includes a radial impeller having a plurality of vanes defining the impingement surfaces, the radial impeller being mounted for rotation on an input shaft; and an output shaft being operatively connected to the input shaft whereby rotation of the input shaft causes rotation of the output shaft, the output shaft being rotationally connected to the rotary output.

In yet a further embodiment, the rotor mechanism includes a radial impeller having a plurality of vanes defining the impingement surfaces, the radial impeller being mounted for rotation on an input shaft; and an output shaft being operatively connected to the input shaft whereby rotation of the input shaft causes rotation of the output shaft, the output shaft being operatively connected to the rotary output via a crank gear and push rod capable of reciprocating an arm connected to the output shaft to cause oscillation of the rotary output over a limited angular range of motion.

In still a further embodiment, a gear chamber isolation member is connected to the distributor body for dividing an interior volume of the distributor body into an enclosed gear chamber and a single, non-annular flow path for the foam to traverse the distributor body without interfering with the gear train.

In accordance with another aspect of the present invention, a distributor for distributing fire-suppressing compressed foam includes a distributor body having an inlet for receiving foam from a compressed foam supply; an impeller rotatably mounted within the body and offset from the inlet, the impeller having a plurality of vanes against which foam impinges to cause the impeller to rotate; and a rotary outlet connected to the impeller for rotation of the outlet relative to the body, when foam impinges on the vanes of the impeller.

In one embodiment, the impeller is mounted to an input shaft geared to an output shaft to which the rotary outlet is mounted.

In another embodiment, the input shaft is geared to the output shaft to enable unconstrained 360-degree rotation of the output shaft and rotary outlet relative to the distributor body.

In yet another embodiment, the input shaft is operatively connected to the output shaft via a reciprocating mechanism to enable rotational oscillation of the rotary outlet relative to the distributor body over a limited arc of motion.

In yet a further embodiment, the rotary outlet is mounted to an outlet shaft for rotation relative to the body, the rotary outlet defining a rotating outlet chamber external from the body, the rotating outlet chamber and the body being in fluid communication via a plurality of exit holes disposed around the output shaft at an interface of the rotary outlet and the body.

In still a further embodiment, a gear chamber isolation member is connected to the distributor body for dividing an interior volume of the distributor body into an enclosed gear chamber and a single, non-annular flow path for the foam to traverse the distributor body without interfering with the gear train.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENTS

Figure 1:
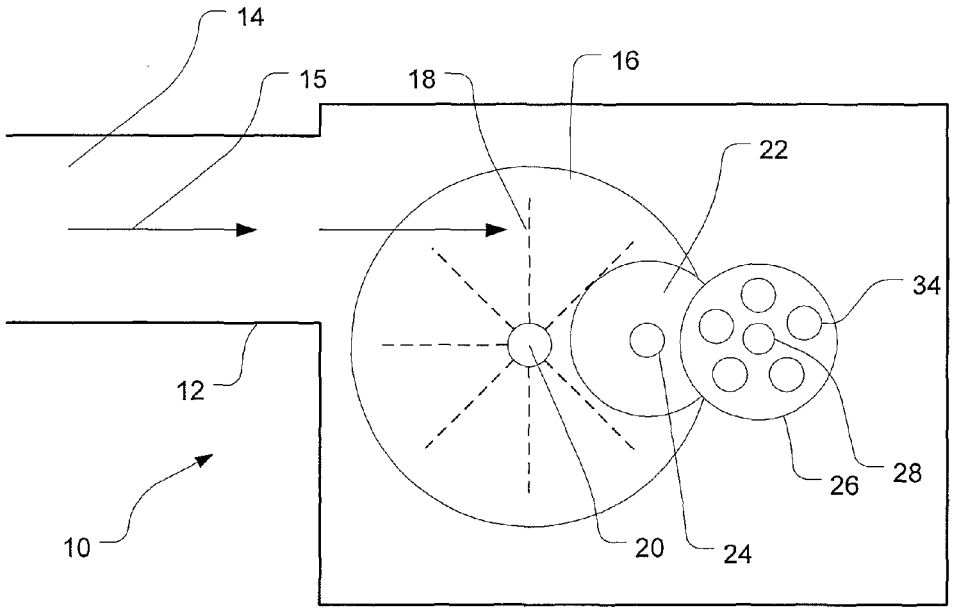
FIG. 1 is a bottom view of a rotary-type foam distributor in accordance with a preferred embodiment of the present invention.

FIG. 1 is a bottom view of a rotary-type foam distributor in accordance with a preferred embodiment of the present invention. As illustrated in FIG. 1, the distributor, which is generally designated by reference numeral 10, has a distributor body 12 (or housing) having a foam inlet 14 for receiving foam, such as compressed-air foam (CAF) or other compressed-gas foam. The incoming foam travels along a foam entry axis 15 from a foam supply which is not shown, but which is known in the art of fixed piping fire-suppression.

Figure 2:
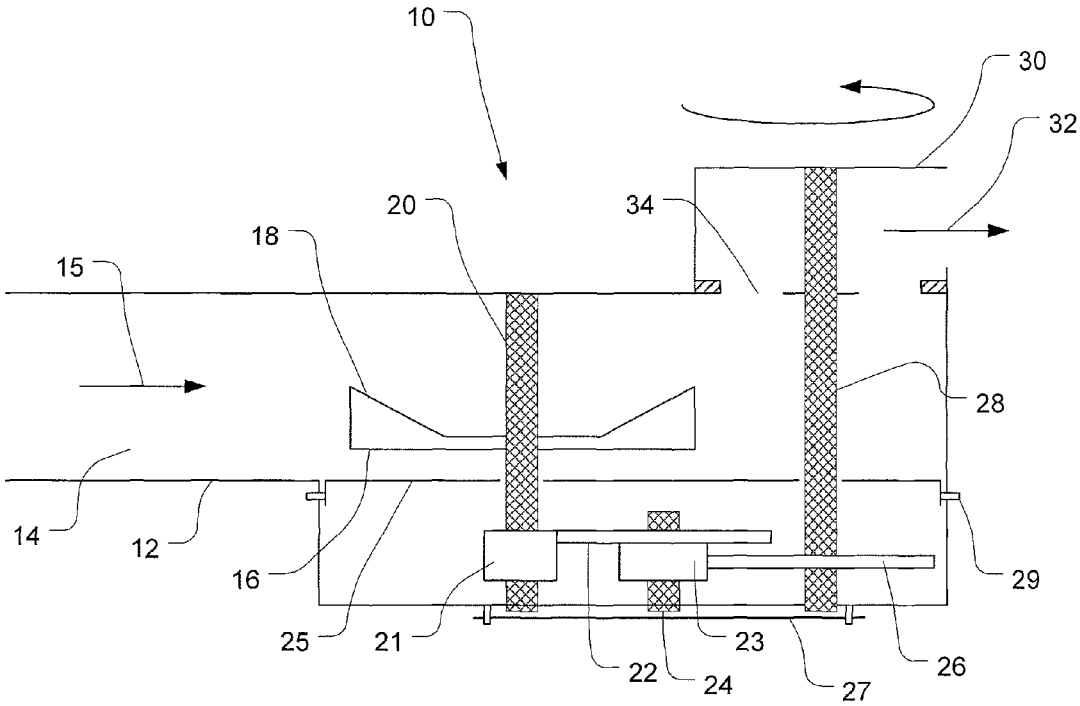
FIG. 2 is a side cross-sectional view of the distributor shown in FIG. 1 but further including a gear chamber isolation plate.

Referring to both FIG. 1 and FIG. 2 (which is a side cross-sectional view of the distributor), the distributor 10 includes a radial impeller 16 (although other equivalent devices include an impingement wheel or a rotor mechanism) which, in turn, has a plurality of vanes 18 or impingement surfaces against which the foam impinges. The radial impeller 16 is offset from the foam entry axis 15 so that impingement of the foam on the vanes of the impeller causes the impeller to rotate. In other words, the centre of the radial impeller 16 (as opposed to an axial impeller taught in the aforementioned United States patent) is spaced apart or offset from the foam entry axis 15, which is aligned to impinge upon the vanes 18. Each vane 18 or impingement surface has a surface area smaller than the foam flow along the foam entry axis 15. The foam entry axis 15 extends from the supply tubing to the radial impeller 16, without any substantial constriction, and indeed the cross-sectional area expands in the illustrated embodiments. The small size of the impingement surfaces relative to the smallest cross-section of the foam entry axis 15, as well as the offset from the foam entry axis are provided to effectively tap the energy of the CAF flow, harnessing a small fraction of the available energy without significantly reducing the range the CAF is projected.

As shown in FIGS. 1 and 2, the radial impeller 16 is mounted to an input shaft 20 that is rotationally secured within the distributor. Preferably, the input shaft 20 is rotationally secured within bearings set in the upper and lower surfaces of the distributor body to provide smooth and efficient rotation of the input shaft 20 relative to the distributor body 12. The input shaft 20 is operatively connected to an output shaft. 28 via a gear train. Specifically in the preferred embodiment, a spur gear 21 is mounted to the input shaft 20 beneath the radial impeller 16. The spur gear 21 meshes with a first intermediary gear 22 mounted on an idler shaft 24. A second intermediary gear 23 mounted on the idler shaft provides a gear reduction and meshing with an output gear 26 mounted on the output shaft 28. Therefore, rotation of the input shaft 20 causes rotation of the output shaft 28, albeit at a reduced angular velocity due to the reduction gearing therebetween. The idler shaft and output shaft can also be rotationally mounted in bearings to provide smoother and more efficient rotation. For optimal performance, depending on the surface area of the impingement surfaces etc., the reduction gear ratio should be between 6:1 and 30:1. This will generally ensure that the angular velocity of the rotary outlet remains within a desired band of about 60 to 180 RPM, although it will be appreciated that CAF flow properties, dimensions and configurations of the impingement surfaces, flow properties in the area of the impeller, and other factors may change the optimal gear ratio and/or angular velocities. Loose meshing of the gears, as is well known in the art, permits operation in a wide range of temperatures, accommodating different thermal expansions of the respective components.

As shown in FIG. 2, the output shaft 28 is securely connected to a rotary outlet 30 which is rotatable relative to the distributor body. The rotary outlet 30 has a vent or exit through which foam is projected as indicated by a foam projection vector 32 in FIG. 2. Occasionally, the rotary outlet 30 is referred to as a "nozzle" even if the outlet does not have a converging cross-section in the downstream direction. Optionally, the rotary outlet can be mounted on a bearing to provide more efficient rotation relative to the distributor body.

In operation, when the fire-suppression system incorporating the distributor 10 is triggered, compressed foam is injected into the inlet 14. The foam impinges on the vanes of the radial impeller, causing the radial impeller to rotate and thereby causing the input shaft to rotate. As the input and output shafts are geared together, rotation of the input shaft causes the output shaft to rotate, albeit at a lesser angular velocity, thus causing the rotary outlet to also rotate relative to the distributor body. Substantially simultaneously, the foam injected into the inlet is forced under pressure through the enclosure defined by the distributor body 12, and is forced upwardly through a plurality of exits 34 into the rotary outlet 30 where it is projected radially outwardly in a circular sweeping pattern as the rotary outlet rotates. In other words, in the preferred embodiment shown in FIG. 2, the rotary outlet 30 can rotate 360 degrees in an unconstrained manner relative to the distributor body to cover a circular target area fully surrounding the distributor.

As shown in FIG. 1, there are preferably five equidistantly spaced exit holes 34 disposed circumferentially around the output shaft 28. As will be understood by those of ordinary skill in the art, the number and shape of the exit holes 34 can be varied, and other mechanisms for securing a rotating nozzle to a distributor body that permit driving of the nozzle can be used, subject to the strenuous demands of fire suppression applications. For example, a chain drive can be used. From FIG. 2 it should be apparent that the foam is first diverted ninety degrees from the horizontal to the vertical by the distributor body and then ninety degrees back to the horizontal by the rotary outlet. Persons of ordinary skill will thus readily appreciate that various refinements can be made to reduce pressure losses as the foam is forced through the two successive ninety-degree turns. For example, it is known in fluid mechanics to introduce smooth bends or elbows to minimize the pressure drop.

As shown in FIG. 2, the rotary outlet 30 causes the foam to divert ninety degrees so that the foam is projected in a direction initially parallel to the foam inlet. In other words, the projection vector 32 revolves in a horizontal plane that is parallel to a horizontal plane of the foam entry axis 15. The low-profile design of this distributor is compact enough to be used in a variety of tight spaces such as, for example, in a trench of an aircraft hangar where foam can be projected under wings and vehicle bodies to smother a ground-based fuel fire. The distributor is compact enough to be used in a variety of other applications as well, not only on the ground but also on walls or ceilings.

Figure 3:
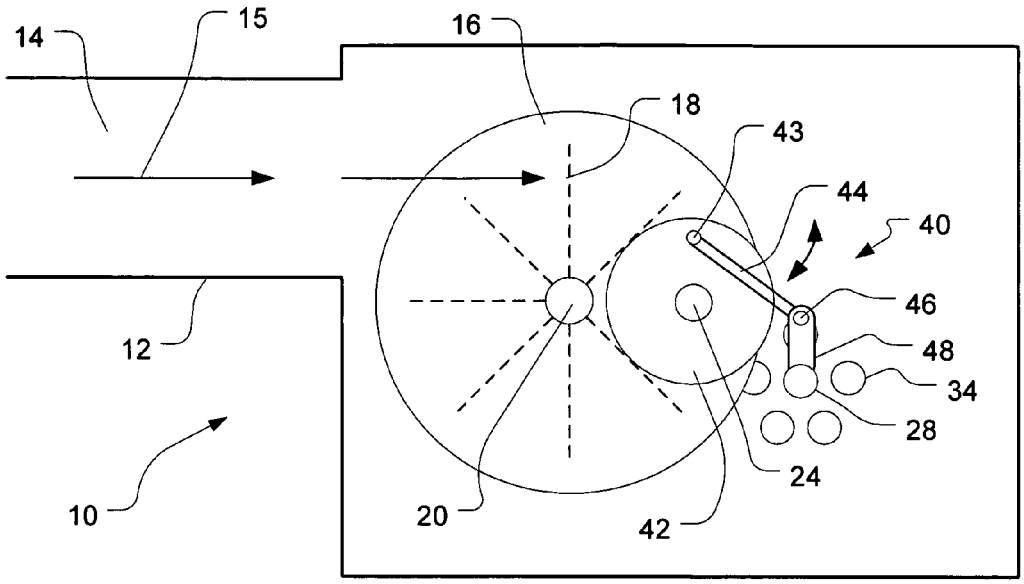
FIG. 3 is a bottom view of a rotary-type foam distributor having an oscillating rotary outlet in accordance with another embodiment of the present invention.
Figure 4:
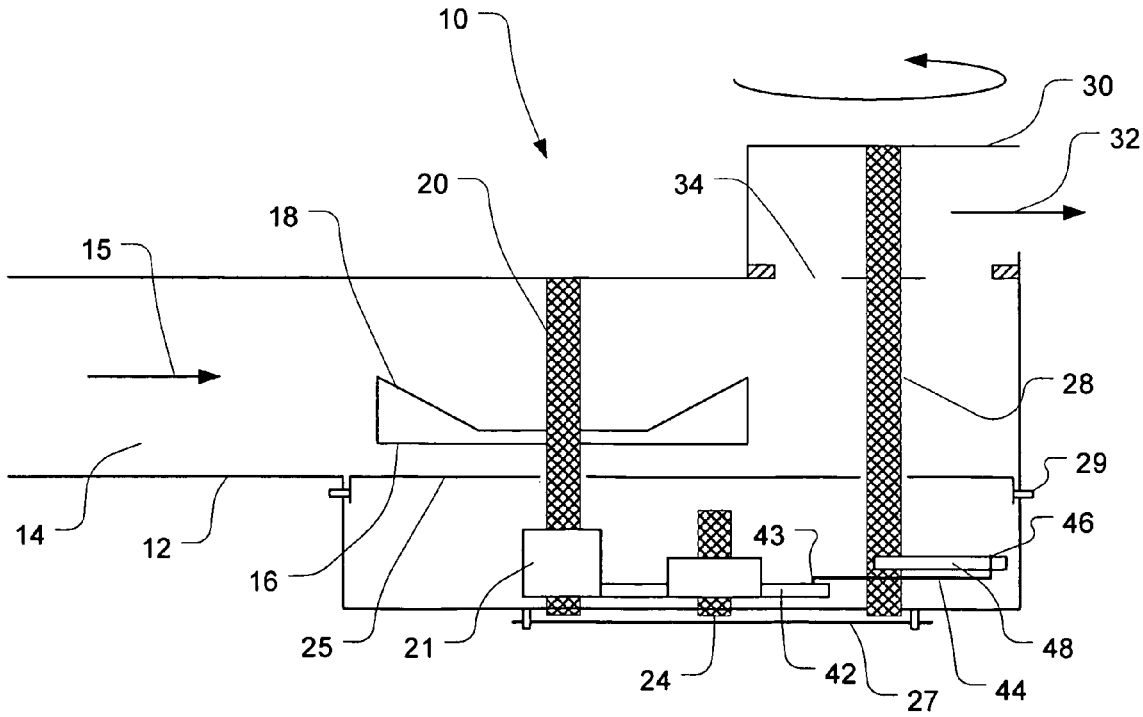
FIG. 4 is a side cross-sectional view of the distributor shown in FIG. 3 but further including a gear chamber isolation plate.

FIGS. 3 and 4 illustrate a distributor 10 having an oscillating rotary outlet in accordance with another embodiment of the present invention. In this embodiment, the radial impeller 16 is operatively connected to the output shaft 28 (and hence to the rotary outlet 30) by an oscillating mechanism 40 having a crank gear 42 meshed to the spur gear 21 of the input shaft 20. The crank gear 42 is pivotally connected (at a first pivot 43) to a reciprocating linkage such as a push rod 44. The push rod 44 connects at a second pivot 46 to an arm 48 fixed to the output shaft. In operation, when the input shaft 20 is rotated by the foam impinging on the radial impeller 16, the output shaft 28 (and hence the rotary outlet 30) rotationally oscillates over a limited arc. In this embodiment, the rotary outlet 30 oscillates back and forth through an angle of about 170 degrees. This design is particularly useful when the distributor is positioned near a wall and the foam is delivered only to the target area away from the wall.

In a preferred embodiment, as illustrated in FIGS. 2 and 4, the distributor 10 includes a gear chamber isolation member, such as a gear chamber isolation plate 25, for isolating the gear train from the flow of CAF. Although this component is not required, as is shown in the embodiments of FIGS. 1 and 3, the gear chamber isolation plate 25 is nevertheless helpful to preclude foam from impeding the smooth movement of the gear train. The gear chamber isolation plate 25 is also useful in situations where rust, or other bodies may be present in the CAF. If a large enough body were to become lodged in the gear train, it will be appreciated that the gear train may seize. By providing a gear chamber isolation plate 25 or the like, interference with the gear train is precluded.

The input and output shafts may be supported by bearings flush mounted to the upper and lower walls of the distributor housing, bearings may be provided in a recess of either the upper or lower walls of the distributor housing, and/or the shafts may extend through one of the upper and lower walls. Preferably, if a shaft extends through a wall of the distributor housing, a shaft cover plate 27, as shown in FIGS. 2 and 4 is provided to prevent corrosion, or mechanical friction with anything below the distributor housing. As will be appreciated by those of ordinary skill in the art, a plurality of shaft cover plates covering individual shafts could also be utilized in lieu of a single shaft cover plate, and numerous other supportive and protecting configurations can be used as a matter of design elective.

As further illustrated in FIGS. 2 and 4, the gear chamber isolation plate 25 and the shaft cover plate 27 can be affixed to the distributor body 12 by anchor rivets 29 or, alternatively, by screws, welding, or other fastening means.

Figure 5:
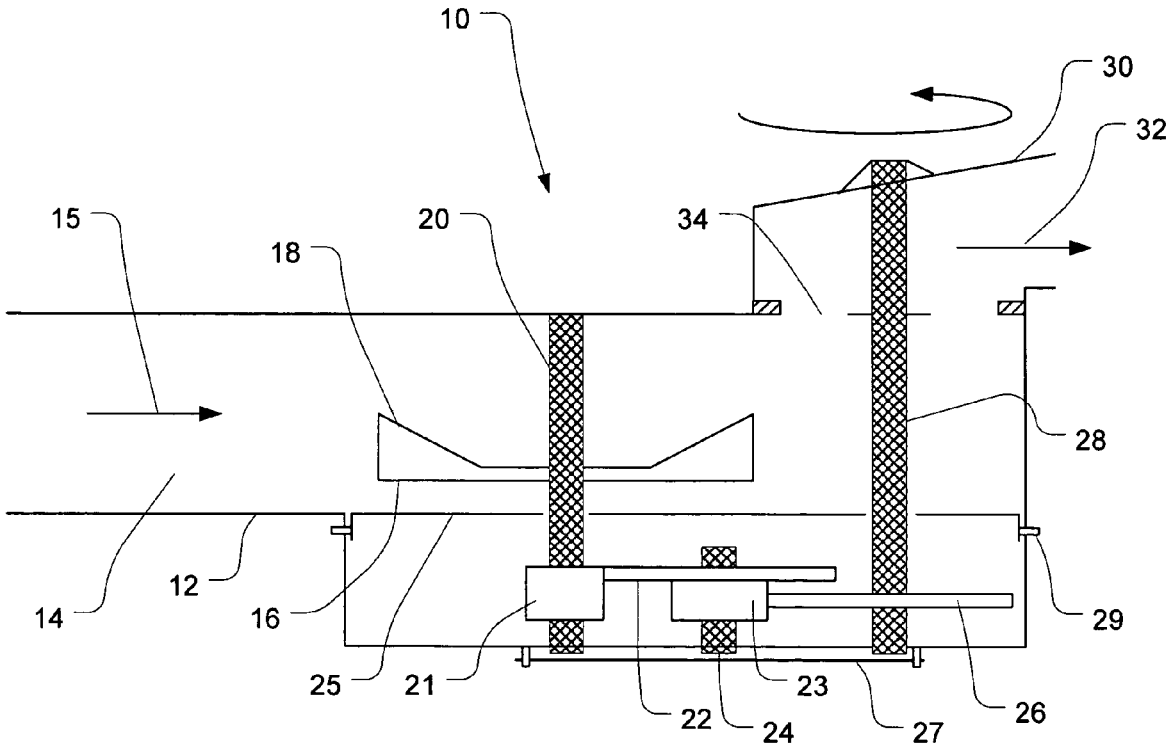
FIG. 5 is a side cross-sectional view of the distributor having a diffuser in accordance with yet another embodiment of the present invention.

FIG. 5 illustrates another embodiment of the distributor where the rotary outlet is a diffuser having a diverging cross-section in the downstream direction. The diffuser reduces the exit velocity of the foam but projects the foam in an expanding cone rather than a cylindrical "rope" of foam. As will be appreciated by those of ordinary skill in the art, the rotary outlet can be a diffuser, a constant-cross-section chamber, or a nozzle depending on the desired projection characteristics. Typically a constant cross-sectional area vent or diffuser is preferable (and not a nozzle which restricts or converges the foam as it exits). Likewise, where a diffuser is used, its design should not cause undue backpressure in the distributor which would stifle the effective throughput of foam through the device.

As will be appreciated by those of ordinary skill in the art, the distributor 10 must be constructed to withstand high temperatures so as to be robust enough to remain operable during a fire. A distributor of this design may be able to withstand at least 600 degrees Celsius (1100 degrees Fahrenheit) for extended periods of time, while in operation.

The distributor 10 harnesses the pressure of the foam to drive the rotary outlet. Therefore, the distributor is self-powered, which reduces installation and operating costs and which also enhances the robustness of the device. Furthermore, the distributor is highly efficient in that it requires very little volume of water and concentrate to cover a fixed area, relative to comparably performing fire-suppression apparatuses. This distributor requires only approximately one quarter to one tenth of the solution of comparable wide-area prior-art systems. Also, as noted above, the distributor is both low-profile and capable of covering 360 degrees, which makes it ideal for trench mounting.

Persons of ordinary skill in the art will appreciate that variations or modifications may be made to the distributor disclosed in the specification and drawings without departing from the spirit and scope of the invention. Furthermore, persons of ordinary skill in the art will appreciate that the distributor described and illustrated merely represents the best mode of implementing the invention known to the Applicant; however, it should be understood that other mechanisms or configurations, using similar or different components, can be used to implement the present invention. Therefore, the embodiments of the invention described above are only intended to be exemplary. The scope of the invention is limited solely by the claims.

What is claimed is:

1. A distributor for distributing foam for extinguishing a fire, the distributor comprising:

a distributor body having an inlet for receiving a flow of foam from a compressed foam supply along a direction of flow of the compressed foam through the body;

a rotor mechanism having a plurality of radial impingement surfaces each of which having a surface area in the flow of the inlet during a respective part of rotation, against which foam impinges to cause the rotor mechanism to rotate, the sum of the surface areas of the radial impingement surfaces in the flow of the inlet being smaller than a smallest cross-sectional area of the flow of foam between the compressed foam supply and the radial impingement surfaces, the rotor mechanism having an input shaft operatively connected to an output shaft via a gear train; and a rotary outlet for projecting the foam in a circular sweeping pattern, the rotary outlet connected to the output shaft for rotation of the outlet relative to the body when foam impinges on the impingement surfaces of the rotor mechanism.

2. The distributor as claimed in claim 1 wherein the rotary outlet is rotationally connected to the rotor mechanism for 360-degree rotation of the outlet relative to the body when foam impinges on the impingement surfaces of the rotor mechanism.

3. The distributor as claimed in claim 1 wherein the rotary outlet is an oscillating rotary outlet connected to the rotor mechanism for oscillation of the rotary outlet relative to the body through a limited arc when foam impinges on the impingement surfaces of the rotor mechanism.

4. The distributor as claimed in claim 2 wherein:

the rotor mechanism comprises an offset radial impeller having a plurality of vanes defining the impingement surfaces, the radial impeller being mounted for rotation on the input shaft; and the output shaft is operatively connected to the input shaft by the gear train such that rotation of the input shaft causes rotation of the output shaft.

5. The distributor as claimed in claim 1, wherein the gear chamber comprises a gear isolation member connected to the distributor body for separating the gear train from the flow path for the foam from the inlet to the rotary outlet, to allow foam to traverse the distributor body without interfering with the gear train.

6. The distributor as claimed in claim 1 wherein the rotary outlet comprises a right-angle elbow for projecting foam in an initially circular plane substantially parallel to the inlet.

7. The distributor as claimed in claim 1 wherein the rotary outlet comprises a diffuser.

8. The distributor as claimed in claim 1 wherein the rotary outlet comprises an exit chamber of constant cross-sectional area.

9. The distributor as claimed in claim 3 wherein the rotor mechanism comprises:

an offset radial impeller having a plurality of vanes defining the impingement surfaces, the radial impeller being mounted for rotation on the input shaft;

the output shaft being operatively connected to the input shaft whereby rotation of the input shaft causes rotation of the output shaft, the output shaft being operatively connected to the rotary output via a crank gear and push rod capable of reciprocating an arm connected to the output shaft to cause oscillation of the rotary output over a limited angular range of motion.

10. The distributor as claimed in claim 1 wherein the rotor mechanism is mounted for rotation about an axis perpendicular to the direction of flow of foam within the body.

11. A distributor for distributing fire-suppressing compressed foam, the distributor comprising:

a distributor body having an inlet for receiving a flow of foam from a compressed foam supply along a direction of flow of the compressed foam within the body;

an impeller rotatably mounted within the body, such that a center of rotation of the impeller is substantially out of the flow of the inlet, the impeller having a plurality of radial vanes, each vane having a radial impingement surface area in the flow of foam, the sum of the radial impingement surface areas in the flow of foam being smaller than the smallest cross sectional area of the flow of foam between the compressed foam supply and the vanes, the surface area of the vanes being in the flow of the foam against which foam impinges to cause the impeller to rotate; and a rotary outlet for projecting the foam in a circular sweeping pattern, the rotary outlet connected to the impeller by means of a gear train for rotation of the outlet relative to the body when foam impinges on the vanes of the impeller.

12. The distributor as claimed in claim 11 wherein the input shaft is geared to the output shaft to enable unconstrained 360-degree rotation of the output shaft and rotary outlet relative to the distributor body.

13. The distributor as claimed in claim 11 wherein the input shaft is operatively connected to the output shaft via a reciprocating mechanism to enable rotational oscillation of the rotary outlet relative to the distributor body over a limited arc of motion.

14. The distributor as claimed in claim 11 wherein the rotary outlet:

defines a rotating outlet chamber external from the body;

is in fluid communication with the body via a plurality of exit holes disposed around the output shaft at an interface of the rotary outlet and the body; or is a diffuser.

15. The distributor as claimed in claim 11 wherein the rotary outlet discharges foam in a direction substantially parallel to the inlet.

16. The distributor as claimed in claim 11:

wherein a plurality of exits from the body into the outlet are disposed circumferentially about the output shaft, or comprising five exit holes disposed equidistantly around the output shaft.

17. The distributor as claimed in claim 11 wherein the gear ratio between the input shaft and the output shaft is between 6:1 and 30:1.

18. The distributor as claimed in claim 11 further comprising a gear chamber isolation member connected to the distributor body for separating the gear train from the flow path of the foam.

19. The distributor as claimed in claim 11 wherein the rotor mechanism is mounted for rotation about an axis perpendicular to the direction of flow of foam within the body.

20. The distributor as claimed in claim 11 wherein:

the gear train is disposed within a gear chamber;

the gear train is disposed within a gear chamber separated from the distributor body from the inlet to the rotary outlet by an isolation member; or the gear train is disposed within a gear chamber separated from the distributor body from the inlet to the rotary outlet by an isolation member having a normal perpendicular to the direction of flow of foam through the body, so as not to interrupt the flow path of the foam from the inlet to the rotary outlet.

* * * * *